US008714721B2

(12) United States Patent
Frazier et al.

(10) Patent No.: US 8,714,721 B2
(45) **Date of Patent: *May 6, 2014**

(54) COMPLIANT LIQUID PATH MEMBER AND RECEPTACLE FOR INK RECIRCULATION

(75) Inventors: Isaac S. Frazier, Portland, OR (US); Nicholas C. Hill, Portland, OR (US); Trevor James Snyder, Newberg, OR (US); Steven Van Cleve Korol, Dundee, OR (US); Devin Kyle Byerley, Keizer, OR (US)

(73) Assignee: Xerox Corporation, Norwalk, CT (US)

( * ) Notice: Subject to any disclaimer, the term of this patent is extended or adjusted under 35 U.S.C. 154(b) by 184 days.

This patent is subject to a terminal disclaimer.

(21) Appl. No.: 13/437,070

(22) Filed: Apr. 2, 2012

(65) Prior Publication Data

US 2013/0258010 A1 Oct. 3, 2013

(51) Int. Cl.
*B41J 2/175* (2006.01)

(52) U.S. Cl.
CPC ..... *B41J 2/17593* (2013.01)
USPC ..... 347/88

(58) Field of Classification Search
CPC ..... B41J 2/17593
USPC ..... 347/88
See application file for complete search history.

(56) References Cited

U.S. PATENT DOCUMENTS

| | | | | |
|---|---|---|---|---|
| 4,970,535 | A * | 11/1990 | Oswald et al. | 347/25 |
| 5,412,411 | A | 5/1995 | Anderson | |
| 5,555,461 | A | 9/1996 | Ackerman | |
| 6,017,110 | A | 1/2000 | Jackson | |
| 6,616,265 | B2 | 9/2003 | Shindo et al. | |
| 6,644,775 | B2 | 11/2003 | Murcia et al. | |
| 7,399,055 | B2 | 7/2008 | Okamoto | |
| 7,878,635 | B2 | 2/2011 | Silverbrook | |
| 7,918,530 | B2 | 4/2011 | Kanfoush et al. | |
| 7,992,986 | B2 | 8/2011 | Snyder et al. | |
| 2004/0075702 | A1 * | 4/2004 | Waller et al. | 346/36 |
| 2005/0225599 | A1 | 10/2005 | Hudd et al. | |
| 2009/0102906 | A1 | 4/2009 | Phillips et al. | |
| 2010/0079537 | A1 | 4/2010 | Watanabe | |
| 2010/0123764 | A1 * | 5/2010 | Slotto et al. | 347/90 |
| 2010/0238227 | A1 | 9/2010 | Nystrom et al. | |
| 2010/0271424 | A1 | 10/2010 | Cunnington et al. | |

* cited by examiner

*Primary Examiner* — Stephen Meier
*Assistant Examiner* — Alexander D Shenderov
(74) *Attorney, Agent, or Firm* — Maginot, Moore & Beck, LLP

(57) ABSTRACT

In an inkjet printer, an ink reclamation apparatus receives ink emitted from at least one printhead. The ink reclamation apparatus includes an ink receptacle and a liquid path member that extends from the ink receptacle to contact the face of at least one printhead proximate to a plurality of inkjets in the at least one printhead. The liquid path member draws liquid ink from the plurality of inkjets and the liquid ink enters the ink receptacle. The ink reclamation apparatus returns the ink to a reservoir in the printhead and reduces or eliminates wasted ink during operation of the at least one printhead.

10 Claims, 8 Drawing Sheets

COMPLIANT LIQUID PATH MEMBER AND RECEPTACLE FOR INK RECIRCULATION

TECHNICAL FIELD

This disclosure relates generally to systems that supply and recover fluid from a device, and more particularly, to an inkjet printer configured to supply liquid ink to an ink reservoir within an inkjet printing apparatus and recover liquid ink from a receptacle associated with the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or as ink sticks of colored ink, which are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is positioned proximate the melt plate to heat the melt plate to a temperature that melts an ink stick coming into contact with the melt plate. The melt plate can be oriented to drip melted ink into a reservoir and the ink stored in the reservoir continues to be heated while awaiting subsequent use.

Fluid couplings in the printer supply the liquid ink held in each reservoir of colored ink to one or more printheads in the inkjet printing apparatus. The liquid ink is pumped from the reservoir to a manifold in the inkjet printing apparatus. As the inkjets in the printheads eject ink onto a receiving medium or imaging member, the action of the diaphragms in the inkjets pulls ink from the manifold. Various embodiments of inkjets include piezoelectric and thermal devices that are selectively activated by a controller with an electrical firing signal.

Phase change ink printers often include one or more heaters that maintain a supply of phase change ink in a liquid state for use during printing operations. Some of the heaters maintain a small supply of ink in the liquid state within the pressure chambers and other fluid conduits within a printhead. Typically, the heaters are electrical heaters that consume electrical energy to maintain the phase change ink in a liquid phase. In order to reduce energy usage, phase change ink printers deactivate various components, including heaters, in the printer during a sleep mode to conserve energy. The ink held in the printheads and inkjets cools and solidifies in some sleep modes.

While sleep modes enable a printer to operate with reduced electrical energy consumption, the solidification of phase change ink within the printer presents difficulties to printing high quality documents when the printer emerges from sleep mode. As phase change ink within an inkjet printing apparatus cools and solidifies, the ink contracts and air enters the pressure chambers and fluid conduits within the printheads. As the solidified ink heats and liquefies during a subsequent warmup process, the air forms bubbles in the liquefied ink that can prevent inkjets in the printheads from operating reliably. Additionally, during the warmup process, both the ink and air bubbles expand due to the heat applied to the printheads. The expanding air bubbles may force some ink through the ejector nozzles, which is referred to as "drooling." The drooled ink can contaminate other nozzles in the printheads or separate from the printheads and produce errant marks on the image receiving member.

To eliminate air bubbles in the liquefied ink within the printheads and to clear contaminants from the inkjet nozzles and external face of each printhead, the inkjet printing apparatus undergoes a "purge" operation where pressure applied to the printheads urges the liquid ink and the air bubbles through the nozzles of the inkjets. In a purge operation, the inkjets emit a stream of ink that flows down the face of the printhead and is collected in a waste ink receptacle instead of being ejected as individual ink drops. The purge operation removes air bubbles from the inkjets in the printheads and other fluid conduits in the inkjet printing apparatus.

In some printing apparatus designs, a wiping operation occurs after the purge operation. In a wiping operation, a wiper blade engages the face of a printhead and moves across the printhead face, including the inkjet nozzles. The wiper blade cleans residual ink and contaminants on the face of the printhead from the purge operation. The wiping operation maintains the meniscus formed between the liquid ink and nozzle in each of the inkjets in the printhead. The meniscus may be broken if the liquid ink contacts a contaminant or another mass of liquefied ink on the face of the printhead. The wiping operation clears the contaminants to enable each inkjet to maintain the meniscus for reliable operation.

In existing printers, the purged ink and ink from a wiping operation is typically collected in a waste reservoir and is eventually discarded. In printers that enter sleep modes more often to reduce electrical energy consumption, the number of purge cycles and the corresponding amount of discarded ink increases. Thus, improvements to phase change ink printers that reduce or eliminate discarded ink produced during purge cycles are desirable.

SUMMARY

In one embodiment, a printing apparatus that reclaims purged ink has been developed. The printing apparatus includes a housing forming a receptacle configured to hold a volume of ink, an opening in the housing configured to enable liquid ink to enter the receptacle, a liquid path member having a first end positioned within the receptacle and a second end extending from the receptacle and the housing, and a positioning system operatively connected to the housing and configured to move the housing to engage the second end of the liquid path member with a face of a printhead at a location below a plurality of inkjets formed in the printhead to provide a fluid path to the receptacle for ink emitted from the plurality of inkjets.

In another embodiment, a printing apparatus that reclaims a plurality of purged inks has been developed. The printing apparatus includes a housing forming a plurality of receptacles, each receptacle in the plurality of receptacles being configured to hold a volume of a single color of ink. Each receptacle further includes an opening formed through the housing to enable a single color of liquid ink to enter the receptacle, a liquid path member having a first end positioned within the receptacle and a second end extending from the receptacle and the housing. The printing apparatus also includes a positioning system operatively connected to the housing. The positioning system is configured to move the housing to engage the second end of the liquid path member in each of the plurality of receptacles with the face of the printhead at a location below each inkjet group in a plurality of inkjet groups in the face of the printhead to provide a fluid path for a single color of ink emitted by each inkjet group to a corresponding receptacle in the plurality of receptacles to enable each receptacle in the plurality of receptacles to receive only one color of ink from the inkjet groups in the printhead.

DETAILED DESCRIPTION

Figure 1:
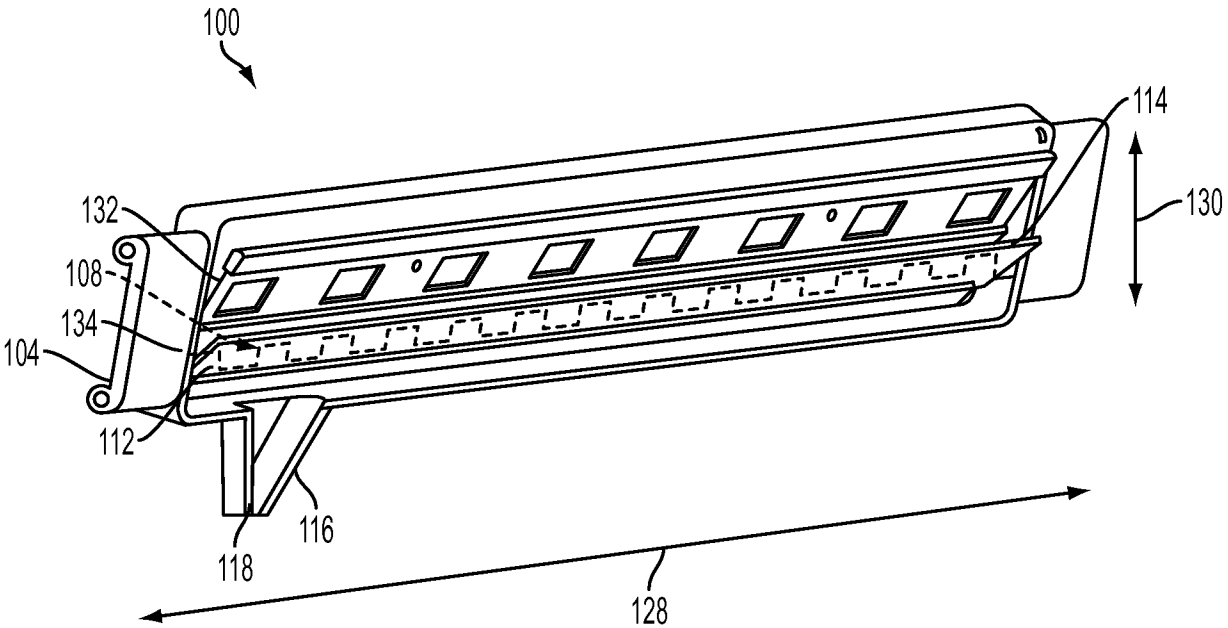
FIG. 1 is a perspective view of a housing that contains a receptacle that receives ink from a printhead.

For a general understanding of the environment for the system and method disclosed herein as well as the details for the system and method, reference is made to the drawings. In the drawings, like reference numerals have been used throughout to designate like elements. The term "conduit" refers to a body having a passageway or lumen through it for the transport of a liquid or a gas. As used herein, a "purge" refers to a maintenance procedure performed by an inkjet printing apparatus to forcibly expel ink from the inkjet ejectors in one or more printheads in an effort to clear the inkjet ejectors and not to form an image on an image receiving surface. A purge can be performed by applying air pressure to an ink reservoir that is fluidly coupled to the inkjets in the printheads or by applying suction to the inkjet nozzles. A purge is typically used to remove air bubbles from conduits within the printheads or other sections of a fluid path in the inkjet printing apparatus that form each time phase change ink is melted from solid to liquid. A purge can also be used to clear contaminants from inkjet ejectors. The term "purged ink" refers to ink expelled during a purge operation. The purged ink flows down the face of the printhead instead of being ejected toward an image receiving surface. As used herein, the terms "solid ink" and "phase change ink" both refer to inks that are substantially solid at room temperature and substantially liquid when heated to a phase change ink melting temperature for jetting onto an imaging receiving surface. The phase change ink melting temperature can be any temperature that is capable of melting solid phase change ink into liquid or molten form.

Figure 8:
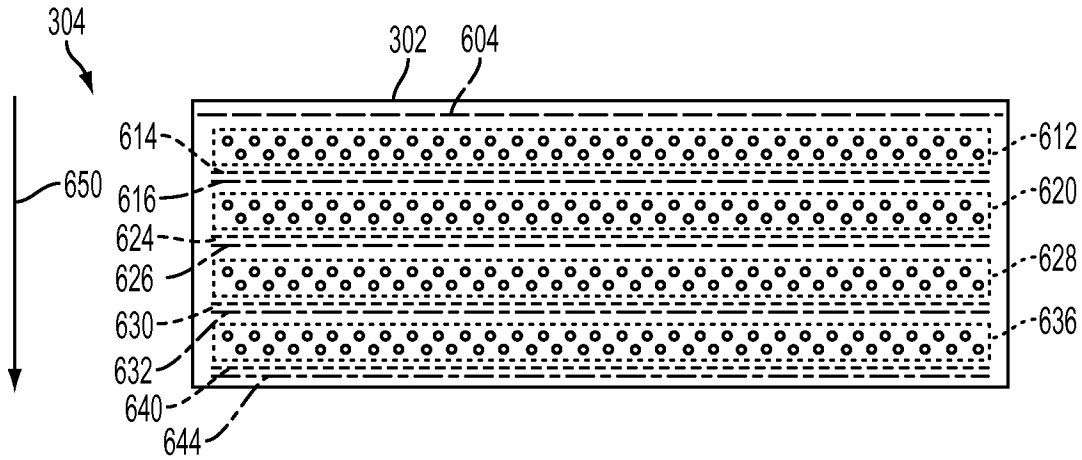
FIG. 8 PRIOR ART
FIG. 8 is a prior art depiction of the face of a multicolor printhead.

As used herein, the term "face" in the context of a printhead refers to an approximately planar region of a printhead that includes a plurality of inkjet nozzles. The printhead ejects ink drops through the apertures in a face plate, sometimes called "nozzles," of the printhead onto an image receiving surface during a printing operation. During a purge operation, ink flows through the nozzles and onto the face of the printhead. FIG. 8 depicts a prior art configuration of the face 302 in a multicolor printhead 304, that is configured to print cyan, magenta, yellow, and black (CMYK) inks. In the multicolor printhead 304, multiple groups of inkjet nozzles are arranged in the face 302. Inkjet groups 612, 620, 628, and 636 eject black, yellow, magenta, and cyan inks, respectively. Each of the inkjet groups includes two rows of inkjet nozzles, but alternative printhead configurations include inkjet nozzles that are grouped in different configurations. Additionally, single color printheads include a printhead face with an arrangement of inkjet nozzles that eject a single color of ink, and alternative multicolor printheads eject different colors of ink than the CMYK configuration of printhead 304.

FIG. 1 depicts an ink recirculation container 100 including a single ink receptacle that receives purged ink from a printhead, holds the purged ink within the receptacle, and empties the purged ink into an ink supply. The ink recirculation container 100 collects ink purged in inkjet printers, including inkjet printers that eject liquid drops of phase change ink, to hold the purged ink and return the purged ink to an ink supply in the printer. The recirculation container 100 includes a housing 104 that forms a receptacle 108 and an outlet 116. A liquid path member 112 extends outward from an opening of the receptacle 108. A wiper 132 is positioned above the receptacle 108 and extends outward from the housing 104. In the embodiment of FIG. 1, the housing 104, receptacle 108, liquid path member 112, and wiper 138 each have a width 128 that corresponds to the width of the face of one printhead. In an alternative embodiment, the housing 104, the receptacle 108, the liquid path member 112, and the wiper 138 each have a width corresponding to two or more printheads that are arranged in a printhead array.

In FIG. 1, the liquid path member 112 extends upward from the housing 104 at an acute angle from a vertical axis 130 of the housing 104. A second end 114 of the liquid path member 112 contacts the face of the printhead during a purge operation. The liquid path member 112 is formed from a resilient material such as a sheet of plastic or a flexible metal sheet. In one embodiment, the liquid path member is formed from a sheet of a thermally conductive polymer with a thickness of approximately 0.075 mm. The orientation of the liquid path member 112 enables the liquid path member 112 to provide a fluid path for ink emitted from the printhead to flow into the receptacle 108 using both capillary forces and gravity to draw the ink into the receptacle 108.

Figure 7A:
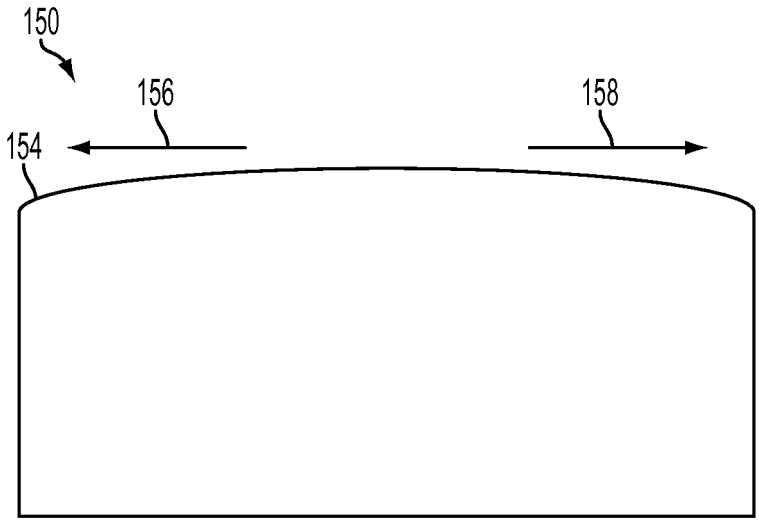
FIG. 7A is a front view of a liquid path member with a convex leading edge that engages the face of a printhead.
Figure 7B:
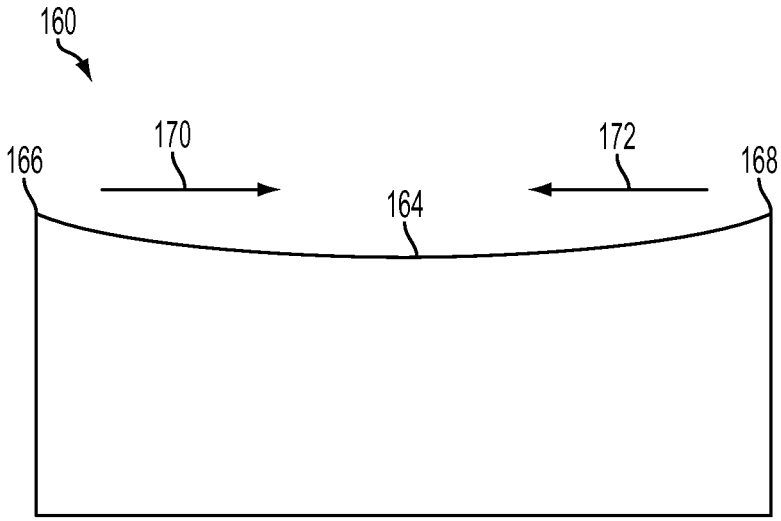
FIG. 7B is a front view of a liquid path member with a concave leading edge that engages the face of a printhead.

In FIG. 1, the second end 114 of the liquid path member 112 is a substantially straight linear edge that engages the face of a printhead. FIG. 7A and FIG. 7B depict two alternative liquid path members with second ends formed in different shapes to engage the printhead face. In FIG. 7A, a liquid path member 150 includes a convex shaped second end 154. The second end 154 engages the printhead proximate to the center of the face, and the liquid path member 150 deforms along a width of the second end 154 to engage the entire width of the printhead face gradually in both directions 156 and 158 starting from the center of the printhead face. In FIG. 7B, a liquid path member 160 includes a concave shaped second end 164. The outer ends 166 and 168 of the liquid path member 160 engage the printhead face proximate to outer edges of the printhead face, and the liquid path member 160 gradually deforms towards the center in directions 170 and 172. The concave configuration of the liquid path member 160 directs ink from the printhead face toward the center of the liquid path member 160 as the ink flows into an ink receptacle. In another configuration, the liquid path member includes alternating concave and convex features in the second end resembling a sinusoidal wave that engage multiple locations across a width of the printhead face.

Referring again to FIG. 1, the liquid path member 112 is configured to provide a path for liquid ink to flow from the printhead to the receptacle, and to maintain a temperature that enables the purged ink to remain liquid until the ink has flowed into the receptacle 108. The resilient material in the liquid path member 112 flexes when engaged to the face of the printhead to conform to the surface of the printhead and form a liquid seal across the face of the printhead that directs the purged ink toward the receptacle 108. The liquid path member 112 draws purged ink from the face of the printhead toward the receptacle 108 via capillary action as well as through force of gravity. In another embodiment, the liquid path member 112 is formed from a rigid member, which is formed with a second end 114 that conforms to the face of the printhead without flexing to provide a liquid path to the receptacle 108. The thermally conductive material forming the liquid path member 112 receives heat from the printhead when the second end 114 of the liquid path member 112 engages the face of the printhead. The liquid path member 112 also has a low thermal mass in comparison to the housing 104. Consequently, the temperature of the liquid path member 112 increases quickly when the second end 114 engages a printhead and liquid ink flows over the liquid path member 112. The low thermal mass of the liquid path member 112 also limits a transfer of heat from the printhead to the housing 104, which enables the receptacle 108 to maintain a temperature that is below the freezing point of the phase change ink.

In the housing 104, the outlet 116 is fluidly coupled to the receptacle 108. Phase change ink flows into the receptacle toward the outlet 116 under the force of gravity. The outlet 116 is formed in a funnel shape that directs the ink to an outlet opening 118. During a purge operation, the housing 104 and outlet 116 are thermally isolated from the printhead and other heated components in an inkjet printer, including heaters in the printhead that heat phase change ink to liquefy the phase change ink for printing and purging operations. Upon entering the receptacle 108, the liquid phase change ink cools and solidifies in the receptacle. Any liquid ink that flows toward the outlet 116 cools and solidifies within the funnel shaped projection of the outlet 116 prior to exiting through the outlet opening 118. The projection of the outlet 116 forms a comparatively large surface area around ink in the outlet 116 to enable the housing 140 to absorb heat from the ink. The ink cools and solidifies within the outlet 116 instead of flowing out of the housing 104. The solidified ink forms a temporary seal that holds any remaining liquid ink in the receptacle 108 until the ink in the receptacle 108 cools and solidifies. In a printing apparatus that employs a liquid ink, such as an aqueous or solvent based ink, the outlet 116 includes a valve that selectively closes to hold ink in the ink receptacle 108, and opens to enable the ink to flow from the ink receptacle 108 through the outlet 116.

The ink recirculation container 100 includes an optional heater 134 positioned within the housing 104 and extending along the width of the ink receptacle 108. In the embodiment of FIG. 1, the heater 134 is an electrical resistive heater formed from nichrome wire or another resistive heating element. The heater 134 is activated when the ink recirculation container 100 and outlet 116 are moved into fluid communication with an ink supply. The heater 134 melts the solidified phase change ink in the receptacle 108 and ink the outlet 116. The liquid ink flows out of the receptacle 108 through the outlet 116 and opening 118, and subsequently enters an ink supply. Alternative embodiments of the ink recirculation container 100 omit the heater 134. In embodiments that omit the heater, another heat source in the inkjet printer applies heat to the ink recirculation container 100 to melt the ink when the outlet 116 is in fluid communication with an ink supply.

The ink recirculation container 100 includes an optional wiper 132. The wiper 132 engages the face of the printhead to remove excess purged ink that remains on the face of the printhead after a purge operation. The orientation of the wiper 132 enables the wiper 132 and the liquid path member 112 to engage the face of the printhead as the wiper 132 moves across the face of the printhead during a printhead maintenance operation. In one embodiment, the wiper 132 is positioned on the surface of the printhead at a location above the excess ink, and an actuator moves the housing 104 and wiper 132 downward across the face of the printhead. The wiper 132 removes the excess ink from the face of the printhead where the excess ink could interfere with operation of inkjets in the printhead. While FIG. 1 depicts one embodiment of a wiper 132 for use in cleaning a printhead, other wiper embodiments include a wiper mounted on a separate housing that moves independently of the housing 104, a filament that moves in close proximity to the printhead face to collect ink via adhesion, or an air knife that cleans residual ink from the printhead face with pressurized air. The printhead face can also be coated with an anti-wetting material to prevent residual ink from adhering to the printhead.

Another embodiment of the ink recirculation container 100 uses the liquid path member 112 as a wiper instead of the wiper member 132. Referring to FIG. 1 and FIG. 8, the liquid path member 112 engages the face 302 of the printhead 304 at location below each of the inkjet groups 612, 620, 628, and 636. Purged ink from each group of inkjets flows down the printhead face 302 and over the liquid path member 112 into the ink receptacle 108. In some embodiments, the liquid path member 112 moves under each group of inkjets to receive the ink, while in other embodiments all of the inkjets in the face of the printhead are purged simultaneously and the liquid path member 112 receives the purged ink from each of the groups of inkjets 612-636. After the purge operation, some residual ink may adhere to the printhead face 302. The ink recirculation container 100 and liquid path member 112 move to location 604 above the inkjet nozzles in the printhead face 302. The liquid path member 112 engages the printhead face 302 at location 604 and moves downward in direction 650 while remaining engaged to the printhead face 302. The liquid path member 112 moves to a location below the plurality of inkjet groups, such as location 644, to wipe the residual ink from the printhead face 302.

The ink recirculation container 100 is configured for use with both single color and multicolor printheads. A single color printhead ejects one color of ink, such as one of a cyan, magenta, yellow, or black ink in a CMYK color printer. In one configuration, the ink recirculation container 100 collects ink from only one printhead and returns the collected ink to an ink supply that supplies the printhead. In another configuration, the ink recirculation container 100 collects ink from each printhead in a plurality of single color printheads. The inks from each printhead mix in the receptacle 108 and the mixed inks are recirculated into a black ink supply for ejection by a black ink printhead. In a multicolor printhead configuration, groups of inkjets formed in the printhead are fluidly coupled to ink supplies that each hold a different color of ink. During a purge operation, the multicolor printhead purges ink of two or more colors into the receptacle 108. The ink recirculation container holds the combined ink in the receptacle until the ink is recirculated into a black ink supply.

Figure 2:
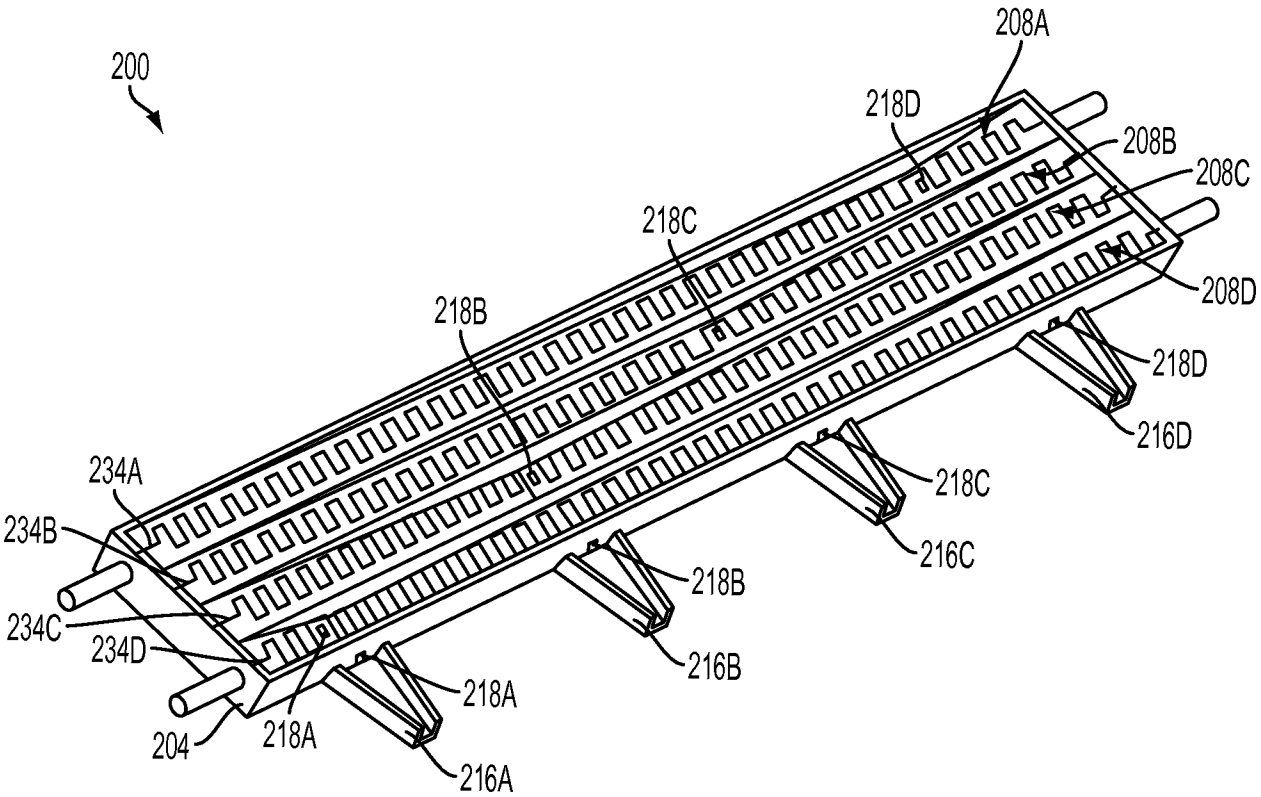
FIG. 2 is a perspective view of a housing that contains a plurality of receptacles that each receive one color of ink from a printhead.

FIG. 2 depicts an ink recirculation container 200 that includes a plurality of ink receptacles with each ink receptacle being configured to hold one color of ink. The ink recirculation container 200 includes a housing 204 that forms ink receptacles 208A, 208B, 208C, and 208D. Each of the ink receptacles 208A-208D is fluidly coupled to only one of fluid conduits 218A-218D, and the fluid conduits 218A-218D place the corresponding ink receptacles 208A-208D in fluid communication with only one of a plurality of outlets 216A-216D. The ink receptacles 208A-208D are fluidly isolated from each other in the housing 204 to prevent different colors of ink from mixing. The ink receptacles 208A-208D include heaters 234A-234D, respectively, that are configured to generate heat to melt solidified ink when the ink recirculation container 200 is in fluid communication with ink supplies in the printer. One embodiment of the housing 204 includes a first metallic housing member that forms the ink receptacles 208A-208D engaged to a second metallic housing member that forms the outlets 216A-216D and fluid conduits 218A-218D. The ink recirculation container 200 includes the four ink receptacles 208A-208D for printers that employ four colors of ink, such as CMYK printers. Alternative embodiments of the ink container 200 include a number of receptacles and outlets that correspond to a number of different colors of ink printed from printheads in the printer.

Figure 4C:
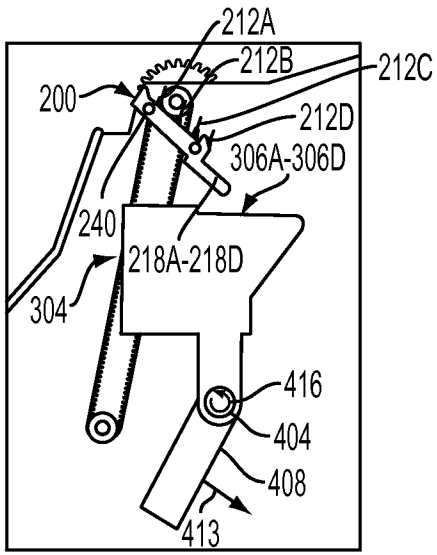
FIG. 4C is a profile view of the housing of FIG. 4A and FIG. 4B with the plurality of receptacles in the housing being in fluid communication with a plurality of ink supplies that supply ink to the printhead.
Figure 4B:
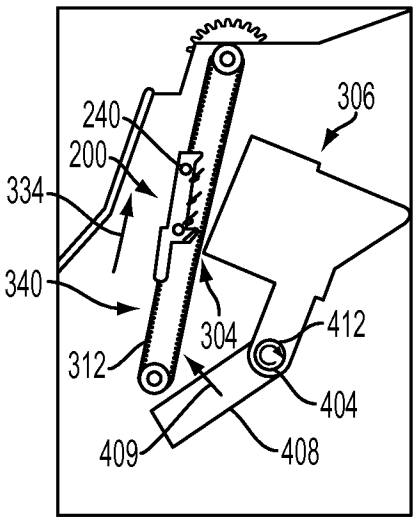
FIG. 4B is a profile view of the housing of FIG. 4A with the printhead being rotated to disengage from the housing.
Figure 4A:
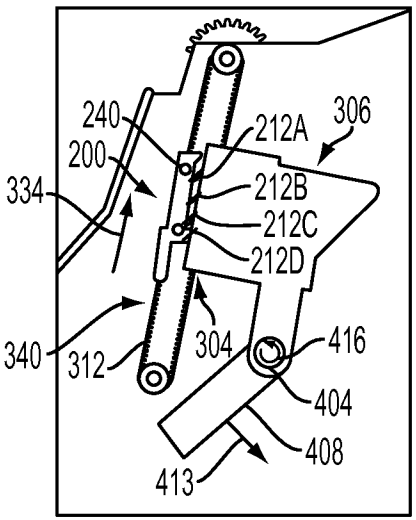
FIG. 4A is a profile view of a housing having a plurality of ink receptacles engaged to the face of a printhead.

In the ink recirculation container 200, each of the ink receptacles 208A-208D includes a liquid path member having a similar configuration to the liquid path member 112 depicted in FIG. 1. The liquid path members are omitted from FIG. 2 for simplicity, but FIG. 4A depicts a profile view of liquid path members 212A-212D that extend from ink receptacles 208A-208D, respectively. The liquid path members 212A-212D each form a fluid seal and enable ink to flow from the face of a printhead into a corresponding one of the ink receptacles 208A-208D. The liquid path members are heated by thermal transfer from the printhead in response to the liquid path member coming into contact with the face of the printhead. The heated liquid path members enable purged ink to remain liquid as the ink flows into one of the corresponding receptacles 208A-208D. The housing 204 remains thermally isolated from the heater in the printhead to enable phase change ink to solidify within each of the ink receptacles 208A-208D.

Figure 3:
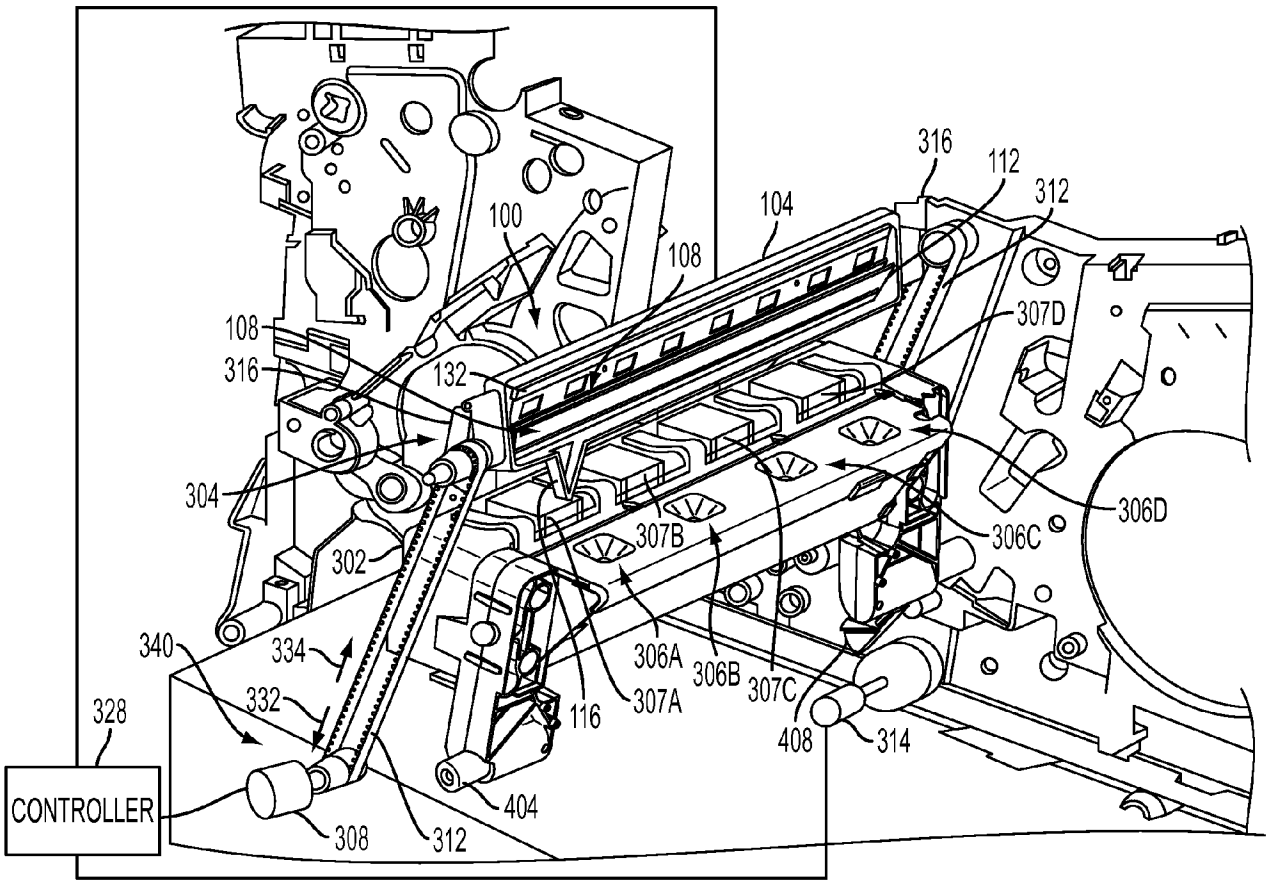
FIG. 3 is a perspective view of the housing and receptacle of FIG. 1 located above an ink supply of a printhead in an inkjet printer.

In operation within an inkjet printer, a positioning system moves both of the ink recirculation containers 100 and 200 between at least two locations to collect purged ink within the containers and to return the purged ink to an ink supply. FIG. 3 depicts a positioning system 340 in an inkjet printer that moves the ink recirculation container 100 into engagement with the face 302 of printhead 304 and into fluid communication with an ink supply 306A. In the example of FIG. 3, the printhead 304 is a multicolor printhead and ink supplies 306A-306D correspond to black, yellow, magenta, and cyan ink supplies, respectively.

The positioning system 340 includes an ink receptacle actuator 308 that drives two toothed belts 312. The two toothed belts 312 engage either end of the ink recirculation receptacle 100 along the width of the housing 104. Retention clips 316 engage each end of the ink receptacle 100 that correspond to one of the drive belts 312, and the ink receptacle 100 moves as indicated by arrows 332 and 334 in response to the actuator 308 rotating the toothed belts 312. In the embodiment of FIG. 3, the positioning system 340 also includes a printhead actuator 314. The printhead actuator 314 moves a cam arm 408 that engages the printhead 304. When activated, the printhead actuator 314 rotates the printhead 304 around a pivot 404 in direction 416 or in direction 412. As described in more detail below, the printhead actuator 314 rotates the printhead 304 in direction 416 to engage liquid path members in the ink receptacle 100, and in direction 412 to disengage from the ink receptacle 100.

In FIG. 3, a controller 328 is operatively connected to the ink receptacle actuator 308 and printhead actuator 314 in the positioning system 340 and to the heater 134 in the in reclamation receptacle 100. The controller 328 is a digital controller such as a microcontroller, microprocessor, field programmable gate array (FPGA), application specific integrated circuit (ASIC) or the like. In some embodiments, the controller 328 is a central control unit that controls the operation of other components and subsystems in an inkjet printer. During a purge operation, the controller 328 selectively activates the actuator 308 to position the ink recirculation container 100 in engagement with the face 302 of the printhead 304. As described in more detail below, the repositioning system 340 moves the ink recirculation container to different locations on the face 302 of the printhead 304 to place the liquid path member 112 into engagement with the face 302 of the printhead 304 at various locations to collect purged ink and to prevent damage to the printhead 304.

In the configuration of FIG. 3, the controller 328 activates the positioning system 340 to move the ink recirculation receptacle into fluid communication with an ink supply 306A after the printhead 304 has purged ink into the ink receptacle 108. The controller 328 activates an electrical current through the heater 134 in the ink reclamation receptacle 108, and the heat from the heater 134 liquefies the solidified ink. The liquefied ink exits the ink receptacle 100 through the outlet 116. The outlet 116 is positioned above an ink supply 306A and the liquefied ink enters the ink supply 306A. The ink supply 306A includes an optional retractable member 307A that opens to enable ink from the recirculation container 100 to enter the ink supply 306A. The ink supplies 306B-306D include retractable members 307B-307D, respectively. Alternative ink supply embodiments include open-topped containers that are located beneath corresponding outlets of the ink receptacles. The printhead 304 uses the recirculated ink in subsequent printing operations. Thus, the purged ink is not discarded after a purge operation, and the ink recirculation receptacle 100 enables efficient use of ink in an inkjet printer.

FIG. 4A depicts the ink receptacle 200 of FIG. 2 engaged to the face 302 of the printhead 304. In FIG. 4A, the positioning system 340 moves the ink recirculation container 200 in direction 334 up the face 302 of the printhead 304. One or more of the liquid path members 212A-212D engage the face 302 of the printhead as the ink recirculation container 200 moves along the face 302 of the printhead 304 in direction 334. In some embodiments, the positioning system 340 moves the ink recirculation container 200 to multiple positions in engagement with the printhead 304 to collect ink from different groups of inkjets in the printhead. In FIG. 4A-FIG. 4C, a cam arm 408 engages the printhead 304 to rotate the printhead 304 around a pivot 404.

In the example of FIG. 4A, the cam arm 408 moves in direction 413 to rotate the printhead 304 in direction 416 around the pivot 404 into engagement with the liquid path members 212A-212D in the ink recirculation container 200. In the configuration of FIG. 4A, purged ink from inkjets in the printhead face 302 flows down one of the liquid path members 212A-212D into the ink recirculation container 200. The positioning system 340 moves the ink recirculation receptacle upward in direction 334 in a series of steps to engage each of the liquid path members 212A-212D beneath corresponding inkjets in the printhead face 302 for the purge operation. In FIG. 4B, the cam arm 408 moves in direction 409 to rotate the printhead 304 in direction 412 to disengage the printhead 304 and ink recirculation container 200. The ink recirculation container moves in direction 334 without dragging or otherwise contacting the liquid path members 212A-212D with the printhead face 302. The cam arm 408 subsequently moves in direction 413 to rotate the printhead in direction 416 and engage the printhead face 302 with the recirculation container 200 to purge another group of inkjets in the printhead 304. In an alternative embodiment, the printhead 302 moves laterally on a set of linear rails or other guides to engage the ink recirculation container 200.

Figure 5B:
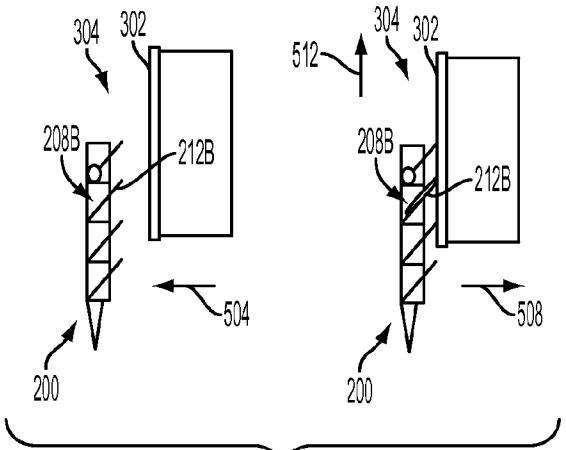
FIG. 5B is a schematic view of the housing of FIG. 2 engaging the printhead of FIG. 3 to receive a second ink from the printhead in a second receptacle in the housing.
Figure 5A:
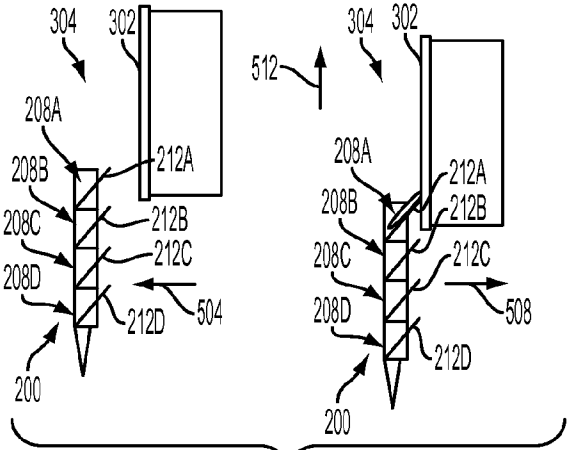
FIG. 5A is a schematic view of the housing of FIG. 2 engaging the printhead of FIG. 3 to receive a first ink from the printhead in a first receptacle in the housing.

As depicted in FIG. 5A-5D, the ink recirculation container 200 moves to four different positions to collect ink from each of the four groups of inkjets in the printhead face 302. In FIG. 5A, the printhead and printhead face 302 move in direction 504 to engage the ink recirculation container 200. As depicted in FIG. 4A and FIG. 4B, the printhead moves into and out of engagement with the ink container 200. The liquid path member 212A engages the printhead face 302 at a position that is below the cyan inkjets 636. Cyan phase change ink that is purged through the inkjets 636 moves over the liquid path member 212A and into the ink receptacle 208A. The cyan phase change ink solidifies within the ink receptacle 208A. After the purged cyan ink flows into the ink receptacle 208A, the printhead moves in direction 508 to disengage from the ink recirculation container 200. The ink recirculation container 200 then moves upward in direction 512 to position ink receptacle 208B to receive magenta ink from the inkjets 628 in the printhead face 302.

Figure 5D:
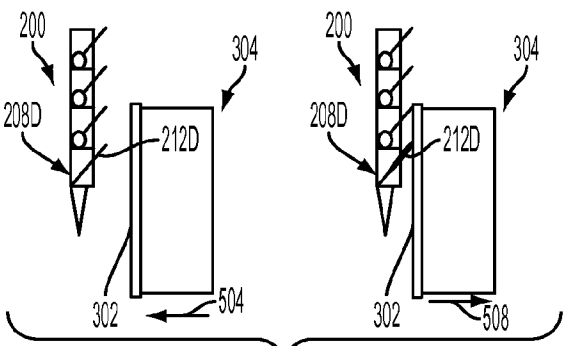
FIG. 5D is a schematic view of the housing of FIG. 2 engaging the printhead of FIG. 3 to receive a fourth ink from the printhead in a fourth receptacle in the housing.
Figure 5C:
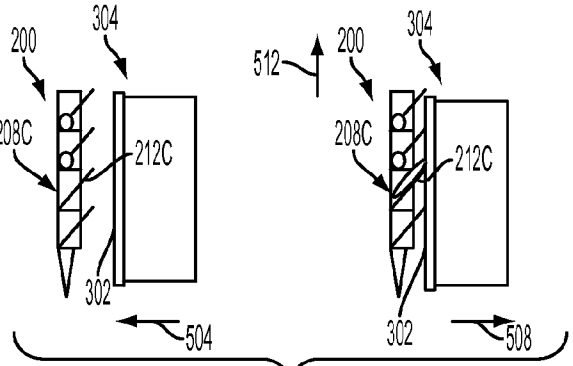
FIG. 5C is a schematic view of the housing of FIG. 2 engaging the printhead of FIG. 3 to receive a third ink from the printhead in a third receptacle in the housing.

In FIG. 5B, the ink recirculation container 200 and printhead 304 operate in a similar manner to FIG. 5A to purge magenta ink from the inkjets 628. The purged magenta ink moves over the liquid path member 212B into the ink receptacle 208B. FIG. 5C and FIG. 5D depict the operations to purge yellow ink from the inkjets 620 over the liquid path member 212C into the ink receptacle 208C, and purge black ink from the inkjets 612 over the liquid path member 212D into the ink receptacle 208D, respectively. The ink recirculation container 200 disengages and re-engages the printhead face 302 so that the liquid path members 212A-212D contact the printhead face 302 without translating or sliding across the printhead face 302. The sliding motion, which is referred to as a "doctoring" motion when the liquid path members move upward in direction 512 while in contact with the printhead face 302, may produce wear on the surface of the printhead face 302. In an alternative embodiment, the ink recirculation container 200 remains engaged to the printhead face 302 and slides across the printhead face 302 in the upward direction 512 to collect purged ink from each group of inkjets.

In one embodiment, the positioning system 340 is configured to engage the liquid path members 212A-212D at different positions on the printhead face 302 to reduce physical wear on the printhead 304. Referring to FIG. 3, FIG. 5A, and FIG. 8, the positioning system 340 moves the liquid path member 212A into engagement under the group of cyan inkjets 636. The controller 328 in the positioning system 340 operates the actuator 308 to move the second end of the liquid path member 212A into engagement with the printhead face 302 at location 644 when the printhead 304 is first installed in the printer. The controller 328 changes the location of the engagement between the liquid path member 212A and the printhead face 302 over the course of multiple purge operations during the life of the printhead 304. In one embodiment, the positioning system 340 gradually moves the location of engagement between the liquid path member 212A and the printhead face 302 from the first location 644 to a second location 640 under the group of inkjet nozzles 636. The change in location of the engagement between the liquid path member 212A and the printhead face 302 reduces wear on the printhead face 302 at a single location. The controller 328 repositions liquid path member 212B between locations 632 and 630, liquid path member 212C between locations 626 and 624, and liquid path member 212D between locations 616 and 614 in a similar manner.

In another embodiment, the positioning system 340 is configured to move the second end of a liquid path member across a portion of the face of the printhead underneath a corresponding group of inkjets during a purge operation. For example, the positioning system 340 engages the liquid path member 212A to the printhead face 302 at location 640 and then moves the ink recirculation container 200 and liquid path member 212A toward location 644 while the liquid path member 212A remains engaged to the printhead face 302. The movement of the ink recirculation container 200 and liquid path member 212A deforms the liquid path member 212A to engage a larger portion of the liquid path member 212A to the printhead face 302 during the purge operation. The deformation of the liquid path member 212A improves the fluid seal formed with the printhead face 302 and produces a larger surface area for capillary forces to draw ink into the ink receptacle 208A. The positioning system 340 moves liquid path member 212B between locations 630 and 632, liquid path member 212C between locations 624 and 626, and liquid path member 212D between locations 614 and 616 in a similar manner.

Figure 6:
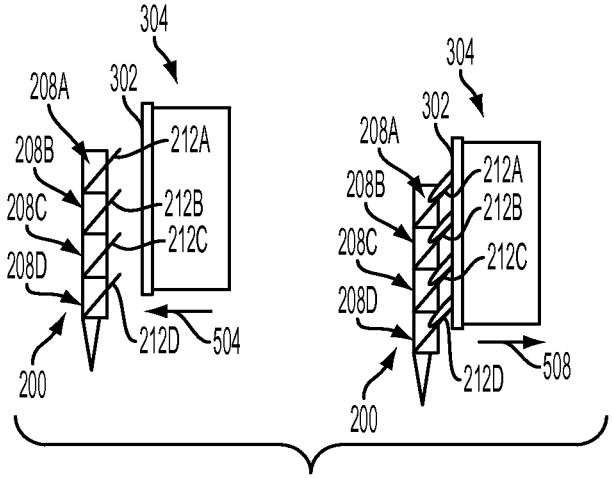
FIG. 6 is a schematic view of the housing of FIG. 2 engaging the printhead of FIG. 3 in a single position to receive four different inks in four ink receptacles.

FIG. 6 depicts another configuration of the ink recirculation container 200 and the printhead 304. In FIG. 6, the dimensions of the ink receptacles 208A-208D and the liquid path members 212A-212D are selected so that the second end of each of the liquid path members aligns with a location below the corresponding group of inkjets in the printhead face 302 without a need to move the ink recirculation container 200 to different locations on the printhead face 302. For example, in FIG. 6 and FIG. 8, the second end of the liquid path member 212A extending out of the ink receptacle 208A contacts the printhead face 302 below the black inkjet group 612 and above the yellow inkjet group 620. The second ends of the other liquid path members 212B-212D simultaneously contact the printhead face to receive purged ink from the inkjet groups 620, 628, and 636, respectively. Thus, in FIG. 6, the ink recirculation container can receive purged ink from all of the inkjets in the printhead 304 while engaging the printhead face 302 in a single location. In one configuration, the printhead 304 purges ink from two or more of the inkjet groups substantially simultaneously, while in another configuration the printhead 304 purges ink from each group of inkjets serially until the purge operation is completed.

After the ink container 200 receives purged ink, the ink recirculation container 200 moves into fluid communication with the ink supplies 306A-306D. FIG. 4C depicts the ink recirculation container 200 in a position to return purged ink stored in each of the ink receptacles 208A-208D to one of ink supplies 306A-306D, respectively. The cam arm 408 moves in direction 413 to rotate the printhead 304 around pivot 404 in direction 416 to position the openings to the ink supplies 306A-306D beneath the ink recirculation container 200. In FIG. 4C, the ink recirculation container rotates about a pivot 240 to position the outlets 218A-218D in fluid communication with openings formed in the ink supplies 306A-306D. The printhead actuator 314 rotates the printhead 304 around the pivot 404 in direction 416 to position the ink supplies 306A-306D under the outlets 218A-218D. The heaters 324A-324D activate to melt ink held in each of the receptacles 208A-208D. The melted ink exits the receptacles 208A-208D in the recirculation container 200 and enters ink supplies 306A-306D. The ink supplies 306A-306D provide the recirculated ink to the printhead 304 for printing operations.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

We claim:

1. A printing apparatus comprising:

a housing forming a receptacle configured to hold a volume of ink;

an opening in the housing configured to enable liquid ink to enter the receptacle;

an outlet formed through the housing, the outlet being configured to enable liquid ink in the receptacle to exit the housing;

a liquid path member having a first end positioned within the receptacle and a second end extending from the receptacle and the housing, the liquid path member being heated to a first temperature that enables liquid ink from the plurality of inkjets to move toward the receptacle in response to engagement of the second end of the liquid path member with the face of the printhead, and the housing maintaining a second temperature that is below the first temperature to enable the liquid ink to solidify in the receptacle;

a positioning system operatively connected to the housing and configured to:

move the housing to engage the second end of the liquid path member with a face of a printhead at a location below a plurality of inkjets formed in the printhead to provide a fluid path to the receptacle for ink emitted from the plurality of inkjets; and move the housing to a second location to place the outlet in fluid communication with an ink supply;

a heater configured to generate heat to melt solidified ink in the receptacle; and a controller operatively connected to the heater, the controller being configured to:

activate the heater in response to the outlet being in fluid communication with the ink supply to melt the solid ink in the receptacle and enable the melted ink to enter the ink supply.

2. The printing apparatus of claim 1, the liquid path member being configured to deform to form a fluid seal with the face of the printhead in response to the second end of the liquid path member engaging the face of the printhead.

3. A printing apparatus comprising:

a housing forming a receptacle configured to hold a volume of ink;

an opening in the housing configured to enable liquid ink to enter the receptacle;

a liquid path member having a first end positioned within the receptacle and a second end extending from the receptacle and the housing; and a positioning system operatively connected to the housing and configured to:

move the housing to engage the second end of the liquid path member with a face of a printhead at a location below a plurality of inkjets formed in the printhead to provide a fluid path to the receptacle for ink emitted from the plurality of inkjets;

move the housing to engage the second end of the liquid path member to the face of the printhead at a first location above the plurality of inkjets; and move the housing and the second end of the liquid path member to a second location on the face of the printhead below the plurality of inkjets, the second end of the liquid path member remaining engaged to the face of the printhead between the first location and the second location.

4. A printing apparatus comprising:

a housing forming a receptacle configured to hold a volume of ink;

an opening in the housing configured to enable liquid ink to enter the receptacle;

a liquid path member having a first end positioned within the receptacle and a second end extending from the receptacle and the housing; and a positioning system operatively connected to the housing and configured to:

move the housing to engage the second end of the liquid path member with a face of a printhead at a location below a plurality of inkjets formed in the printhead to provide a fluid path to the receptacle for ink emitted from the plurality of inkjets;

move the housing to engage the second end of the liquid path member to the face of the printhead at a first location below the plurality of inkjets; and move the housing and the second end of the liquid path member to a second location on the face of the printhead below the plurality of inkjets and below the first location, the second end of the liquid path member remaining engaged to the face of the printhead between the first location and the second location.

5. A printing apparatus comprising:

a housing forming a receptacle configured to hold a volume of ink;

an opening in the housing configured to enable liquid ink to enter the receptacle;

a liquid path member having a first end positioned within the receptacle and a second end extending from the receptacle and the housing; and a positioning system operatively connected to the housing and configured to:

move the housing to engage the second end of the liquid path member with a face of a printhead at a location below a plurality of inkjets formed in the printhead to provide a fluid path to the receptacle for ink emitted from the plurality of inkjets;

engage the second end of the liquid path member to the face of the printhead at a first location below the plurality of inkjets in the face of the printhead at a first time; and engage the second end of the liquid path member to the face of the printhead at a second location below the plurality of inkjets in the face of the printhead and above the first location at a second time.

6. A printing apparatus comprising:

a housing forming a plurality of receptacles, each receptacle in the plurality of receptacles being configured to hold a volume of a single color of ink, each receptacle further comprising:

an opening formed through the housing to enable a single color of liquid ink to enter the receptacle; and a liquid path member having a first end positioned within the receptacle and a second end extending from the receptacle and the housing, the liquid path member in each of the plurality of receptacles being heated to a first temperature in response to engagement with the face of the printhead to enable liquid ink to move toward the housing, and the housing maintaining a second temperature that is below the first temperature to enable liquid ink to solidify in each receptacle in the plurality of receptacles;

a plurality of outlets formed through the housing, each outlet in the plurality of outlets being fluidly coupled to only one receptacle in the plurality of receptacles to enable liquid ink in each receptacle to exit the housing through the corresponding outlet for each receptacle; and a positioning system operatively connected to the housing, the positioning system being configured to:

move the housing to engage the second end of the liquid path member in each of the plurality of receptacles with the face of the printhead at a location below each inkjet group in a plurality of inkjet groups in the face of the printhead to provide a fluid path for a single color of ink emitted by each inkjet group to a corresponding receptacle in the plurality of receptacles to enable each receptacle in the plurality of receptacles to receive only one color of ink from the inkjet groups in the printhead; and move the housing to a second location to place each outlet in the plurality of outlets in fluid communication with only one ink supply in a plurality of ink supplies; and a heater configured to generate heat to melt solidified ink in the plurality of receptacles; and a controller operatively connected to the heater, the controller being configured to:

activate the heater in response to each outlet in the plurality of outlets being in fluid communication with the only one ink supply in the plurality of ink supplies to melt solid ink in each receptacle in the plurality of receptacles and enable the melted ink to enter the corresponding one ink supply in the plurality of ink supplies.

7. The printing apparatus of claim 6, the liquid path member in each of the plurality of receptacles being configured to deform to form a fluid seal with the face of the printhead in response to the second end of the liquid path member engaging the face of the printhead.

8. A printing apparatus comprising:

a housing forming a plurality of receptacles, each receptacle in the plurality of receptacles being configured to hold a volume of a single color of ink, each receptacle further comprising:

an opening formed through the housing to enable a single color of liquid ink to enter the receptacle; and a liquid path member having a first end positioned within the receptacle and a second end extending from the receptacle and the housing; and a positioning system operatively connected to the housing, the positioning system being configured to:

move the housing to engage the second end of the liquid path member in each of the plurality of receptacles with the face of the printhead at a location below each inkjet group in a plurality of inkjet groups in the face of the printhead to provide a fluid path for a single color of ink emitted by each inkjet group to a corresponding receptacle in the plurality of receptacles to enable each receptacle in the plurality of receptacles to receive only one color of ink from the inkjet groups in the printhead;

move the housing to engage the second end of the liquid path member in one receptacle to the face of the printhead at a first location above one inkjet group; and move the housing and the second end of the liquid path member in the one receptacle to a second location on the face of the printhead below the one inkjet group and below the first location, the second end of the liquid path member in the one receptacle remaining engaged to the face of the printhead between the first location and the second location.

9. A printing apparatus comprising:

a housing forming a plurality of receptacles, each receptacle in the plurality of receptacles being configured to hold a volume of a single color of ink, each receptacle further comprising:

an opening formed through the housing to enable a single color of liquid ink to enter the receptacle; and a liquid path member having a first end positioned within the receptacle and a second end extending from the receptacle and the housing; and a positioning system operatively connected to the housing, the positioning system being configured to:

move the housing to engage the second end of the liquid path member in each of the plurality of receptacles with the face of the printhead at a location below each inkjet group in a plurality of inkjet groups in the face of the printhead to provide a fluid path for a single color of ink emitted by each inkjet group to a corresponding receptacle in the plurality of receptacles to enable each receptacle in the plurality of receptacles to receive only one color of ink from the inkjet groups in the printhead;

move the housing to engage the second end of the liquid path member in one receptacle to the face of the printhead at a first location below one inkjet group; and move the housing and the second end of the liquid path member in the one receptacle to a second location on the face of the printhead below the one inkjet group, the second end of the liquid path member in the one receptacle remaining engaged to the face of the printhead between the first location and the second location.

10. A printing apparatus comprising:

a housing forming a plurality of receptacles, each receptacle in the plurality of receptacles being configured to hold a volume of a single color of ink, each receptacle further comprising:

an opening formed through the housing to enable a single color of liquid ink to enter the receptacle; and a liquid path member having a first end positioned within the receptacle and a second end extending from the receptacle and the housing; and a positioning system operatively connected to the housing, the positioning system being configured to:

move the housing to engage the second end of the liquid path member in each of the plurality of receptacles with the face of the printhead at a location below each inkjet group in a plurality of inkjet groups in the face of the printhead to provide a fluid path for a single color of ink emitted by each inkjet group to a corresponding receptacle in the plurality of receptacles to enable each receptacle in the plurality of receptacles to receive only one color of ink from the inkjet groups in the printhead;

engage the second end of the liquid path member in one receptacle to the face of the printhead at a first location below one inkjet group in the face of the printhead at a first time; and engage the second end of the liquid path member in the one receptacle to the face of the printhead at a second location below the one inkjet group in the face of the printhead and above the first location at a second time.

* * * * *